US011585285B2

(12) United States Patent
Mizutani et al.

(10) Patent No.: US 11,585,285 B2
(45) Date of Patent: Feb. 21, 2023

(54) CONTROLLER FOR INTERNAL COMBUSTION ENGINE

(71) Applicant: TOYOTA JIDOSHA KABUSHIKI KAISHA, Aichi-ken (JP)

(72) Inventors: Takamitsu Mizutani, Toyota (JP); Yusuke Joh, Toyota (JP); Masanao Idogawa, Nagoya (JP); Takeshi Genko, Nisshin (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 17/076,805

(22) Filed: Oct. 22, 2020

(65) Prior Publication Data

US 2021/0140381 A1 May 13, 2021

(30) Foreign Application Priority Data

Nov. 13, 2019 (JP) ..... JP2019-205394

(51) Int. Cl.
*F02D 41/14* (2006.01)
*F02D 41/30* (2006.01)
*F01N 3/28* (2006.01)

(52) U.S. Cl.
CPC ..... *F02D 41/1454* (2013.01); *F01N 3/28* (2013.01); *F02D 41/30* (2013.01)

(58) Field of Classification Search
CPC . F01N 11/007; F01N 3/10; F01N 3/20; F01N 3/28; F01N 9/00; F01N 2430/06; F01N 2560/025; F01N 2900/1624; F01N 3/00; F02D 41/126; F02D 41/1454; F02D 41/1475; F02D 41/30; F02D 41/1441; F02D 45/00; F02D 2200/0814; F02D 9/02; F02D 41/0275; F02D 41/1462; F02D 41/1458; F02D 41/2429; F02D 41/1405; Y02T 10/40; F02M 51/00
USPC ..... 60/276
See application file for complete search history.

(56) References Cited

U.S. PATENT DOCUMENTS

2002/0157379 A1* 10/2002 Kakuyama ..... B01D 53/9495 60/276
2004/0139736 A1* 7/2004 Yoshizawa ..... F02D 41/1479 60/285
2011/0120095 A1* 5/2011 Wald ..... F01N 11/00 60/299

(Continued)

FOREIGN PATENT DOCUMENTS

JP 2005201112 A * 7/2005
JP 2005201112 A 7/2005

*Primary Examiner* — Devon C Kramer
*Assistant Examiner* — Kelsey L Stanek
(74) *Attorney, Agent, or Firm* — Hauptman Ham, LLP

(57) ABSTRACT

A controller for an internal combustion engine is configured to execute a rich air-fuel ratio control for performing fuel injection while setting a target equivalence ratio such that, at recovery from a fuel cutoff process, an air-fuel ratio of air-fuel mixture is richer than a stoichiometric air-fuel ratio. The controller is configured to execute a target equivalence ratio setting process for setting the target equivalence ratio that is maintained during execution of the rich air-fuel ratio control such that the target equivalence ratio increases as an air excess ratio that is calculated from an output value of a second air-fuel ratio sensor at start of the rich air-fuel ratio control increases.

2 Claims, 4 Drawing Sheets

(56) References Cited

U.S. PATENT DOCUMENTS

2020/0116094 A1* 4/2020 Ge ..... F02D 41/2429

* cited by examiner

CONTROLLER FOR INTERNAL COMBUSTION ENGINE

RELATED APPLICATIONS

The present application claims priority of Japanese Application Number 2019-205394, filed on Nov. 13, 2019, the disclosure of which is hereby incorporated by reference herein in its entirety.

BACKGROUND

1. Field

The present disclosure relates to a controller for an internal combustion engine.

2. Description of Related Art

When a fuel cutoff process is executed in an internal combustion engine, the oxygen storage amount of a catalyst in the exhaust passage increases. If the oxygen storage amount exceeds an appropriate value and becomes excessive, NOx reduction in the catalyst slows when combustion of air-fuel mixture is started after recovery from the fuel cutoff process.

For example, Japanese Laid-Open Patent Publication No. 2005-201112 discloses a controller that executes rich air-fuel ratio control when the oxygen storage amount of a catalyst exceeds a specified value during a fuel cutoff process. The rich air-fuel ratio control refers to control for performing fuel injection such that the air-fuel ratio of air-fuel mixture is richer than the stoichiometric air-fuel ratio at recovery from a fuel cutoff process.

When the rich air-fuel ratio control is executed, the catalyst is exposed to a fuel-rich atmosphere. This promotes release of stored oxygen, so that the NOx reduction action of the catalyst is restored.

During the execution of the rich air-fuel ratio control, the air excess ratio of the gas that has passed through the catalyst changes from a lean value to a stoichiometric value. When a target equivalence ratio of the air-fuel mixture during the rich air-fuel ratio control is calculated such that the target equivalence ratio tracks actual changes in the air excess ratio, the value of the target equivalence ratio decreases in accordance with decrease of the air excess ratio due to the execution of the rich air-fuel ratio control. Accordingly, the release of oxygen from the catalyst gradually slows, and the purification performance of the catalyst may become difficult to restore at an early stage.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In a first aspect of the present disclosure, a controller for an internal combustion engine is provided. The controller is configured to control an internal combustion engine that includes a catalyst provided in an exhaust passage and an air-fuel ratio sensor that outputs a signal proportional to an oxygen concentration of gas that has passed through the catalyst. The controller is configured to execute: a rich air-fuel ratio control for performing fuel injection while setting a target equivalence ratio such that, at recovery from a fuel cutoff process, an air-fuel ratio of air-fuel mixture is richer than a stoichiometric air-fuel ratio; and a target equivalence ratio setting process for setting the target equivalence ratio that is maintained during execution of the rich air-fuel ratio control such that the target equivalence ratio increases as an air excess ratio that is calculated from an output value of the air-fuel ratio sensor at start of the rich air-fuel ratio control increases.

The air excess ratio at the start of the rich air-fuel ratio control becomes larger as the amount of the oxygen stored by the catalyst during the fuel cutoff process increases. In this regard, the above-described configuration sets the target equivalence ratio in correspondence with the air excess ratio at the start of the rich air-fuel ratio control, and maintains the set target equivalence ratio. Thus, during the execution of the rich air-fuel ratio control, the target equivalence ratio is maintained as a large value on the rich air-fuel ratio side. As a result, release of oxygen from the catalyst is promoted, and the purification performance of the catalyst is restored at an early stage.

In a second aspect of the present disclosure, a controller for an internal combustion engine is provided. The controller is configured to control an internal combustion engine that includes a catalyst provided in an exhaust passage and an air-fuel ratio sensor that outputs a signal proportional to an oxygen concentration of gas that has passed through the catalyst. The controller is configured to execute: a rich air-fuel ratio control for performing fuel injection while setting a target equivalence ratio such that, at recovery from a fuel cutoff process, an air-fuel ratio of air-fuel mixture is richer than a stoichiometric air-fuel ratio; a setting process for setting an initial value of an excess ratio stored value to an air excess ratio that is calculated from an output value of the air-fuel ratio sensor at start of the rich air-fuel ratio control; a target equivalence ratio setting process for setting the target equivalence ratio that is maintained during execution of the rich air-fuel ratio control such that the target equivalence ratio increases as the excess ratio stored value increases; and an update process for setting the excess ratio stored value to an air excess ratio that is calculated from an output value of the air-fuel ratio sensor during execution of the rich air-fuel ratio control, each time the air excess ratio exceeds the excess ratio stored value.

The above-described configuration sets the initial value of the air excess ratio stored value to the air excess ratio at the start of the rich air-fuel ratio control. As long as the air excess ratio during the execution of the rich air-fuel ratio control does not exceed the air excess ratio stored value, the initial value is maintained as the air excess ratio stored value, and the target equivalence ratio is calculated on the basis of the initial value.

The initial value, that is, the air excess ratio at the start of the rich air-fuel ratio control, becomes greater as the amount of the oxygen stored by the catalyst during the fuel cutoff process increases. In this regard, as long as the air excess ratio during the execution of the rich air-fuel ratio control does not exceed the air excess ratio stored value, the above-described configuration sets the target equivalence ratio in correspondence with the air excess ratio at the start of the rich air-fuel ratio control, and maintains the set target equivalence ratio. Thus, during the execution of the rich air-fuel ratio control, the target equivalence ratio is maintained as a large value on the rich air-fuel ratio side. As a result, release of oxygen from the catalyst is promoted, and the purification performance of the catalyst is restored at an early stage.

In contrast, when the air excess ratio during the execution of the rich air-fuel ratio control exceeds the air excess ratio stored value, the air excess ratio that exceeded the air excess ratio stored value is used as a new air excess ratio stored value, so that the air excess ratio stored value is updated. Since the updated air excess ratio stored value is greater than the air excess ratio stored value before the update, the value of the target equivalence ratio that is calculated on the basis of the updated air excess ratio stored value is greater than the target equivalence ratio calculated on the basis of the air excess ratio stored value before the update. The catalyst is thus exposed to a more fuel-rich atmosphere, which further promotes release of the stored oxygen. The purification performance of the catalyst is thus restored at an earlier stage.

In a third aspect of the present disclosure, a controller configured to control an internal combustion engine is provided. The internal combustion engine includes a catalyst provided in an exhaust passage and an air-fuel ratio sensor that outputs a signal proportional to an oxygen concentration of gas that has passed through the catalyst. The controller includes processing circuitry. The processing circuitry is configured to execute: a rich air-fuel ratio control for performing fuel injection while setting a target equivalence ratio such that, at recovery from a fuel cutoff process, an air-fuel ratio of air-fuel mixture is richer than a stoichiometric air-fuel ratio; and a target equivalence ratio setting process for setting the target equivalence ratio that is maintained during execution of the rich air-fuel ratio control such that the target equivalence ratio increases as an air excess ratio that is calculated from an output value of the air-fuel ratio sensor at start of the rich air-fuel ratio control increases.

In a fourth aspect of the present disclosure, a controller configured to control an internal combustion engine is provided. The internal combustion engine includes a catalyst provided in an exhaust passage and an air-fuel ratio sensor that outputs a signal proportional to an oxygen concentration of gas that has passed through the catalyst. The controller comprises processing circuitry. The processing circuitry is configured to execute: a rich air-fuel ratio control for performing fuel injection while setting a target equivalence ratio such that, at recovery from a fuel cutoff process, an air-fuel ratio of air-fuel mixture is richer than a stoichiometric air-fuel ratio; a setting process for setting an initial value of an excess ratio stored value to an air excess ratio that is calculated from an output value of the air-fuel ratio sensor at start of the rich air-fuel ratio control; a target equivalence ratio setting process for setting the target equivalence ratio that is maintained during execution of the rich air-fuel ratio control such that the target equivalence ratio increases as the excess ratio stored value increases; and an update process for setting the excess ratio stored value to an air excess ratio that is calculated from an output value of the air-fuel ratio sensor during execution of the rich air-fuel ratio control, each time the air excess ratio exceeds the excess ratio stored value.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

First Embodiment

A controller 100 for an internal combustion engine 10 according to a first embodiment will now be described with reference to FIGS. 1 to 3.

Figure 1:
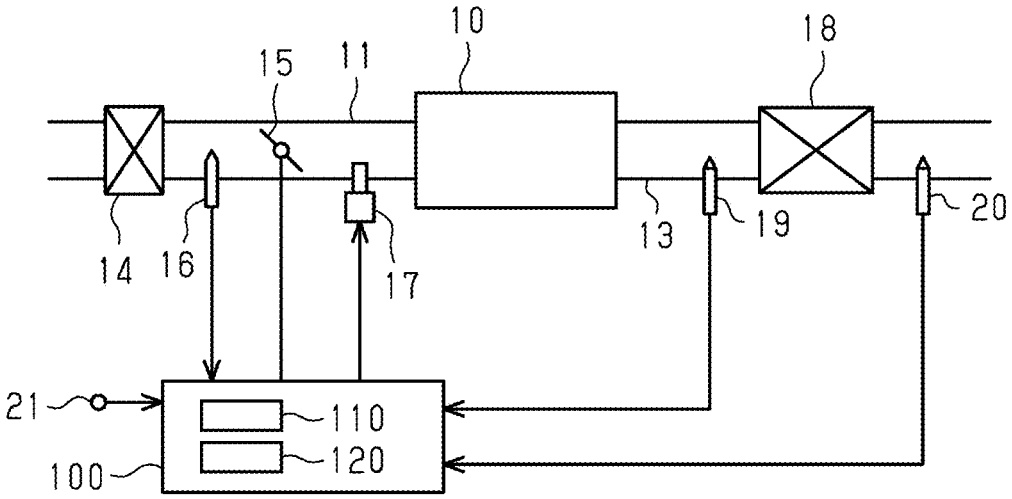
FIG. 1 is a schematic diagram of an internal combustion engine equipped with a controller according to a first embodiment and the structure around the internal combustion engine.

As shown in FIG. 1, an intake passage 11 is connected to the internal combustion engine 10. The intake passage 11 includes a throttle valve 15, which varies the passage cross-sectional area. The opening degree of the throttle valve 15 is controlled to regulate the amount of intake air through an air cleaner 14. The amount of intake air, or an intake air amount GA, is detected by an air flow meter 16. The intake air drawn into the intake passage 11 is mixed with fuel injected from an injector 17 arranged downstream of the throttle valve 15, and is then delivered to a combustion chamber of the internal combustion engine 10 to be burned.

Exhaust gas generated by combustion in the combustion chamber is delivered to an exhaust passage 13, which includes a catalyst 18 for purifying components in the exhaust gas. When combustion is performed around the stoichiometric air-fuel ratio, the catalyst 18 oxidizes HC and CO in the exhaust gas and reduces NOx in the exhaust gas, thereby purifying the exhaust gas. The catalyst 18 stores oxygen. That is, when exposed to a fuel-lean atmosphere, the catalyst 18 stores oxygen. When exposed to a fuel-rich atmosphere, the catalyst 18 releases stored oxygen.

A first air-fuel ratio sensor 19 is provided upstream of the catalyst 18, and a second air-fuel ratio sensor 20 is provided downstream of the catalyst 18.

The first air-fuel ratio sensor 19 and the second air-fuel ratio sensor 20 are known limiting current type oxygen sensors. A limiting current type oxygen sensor includes a ceramic layer, which is called a diffusion-controlled layer, in a detection section of a concentration cell type oxygen sensor, and outputs a current proportional to the oxygen concentration in exhaust gas. When the air-fuel ratio, which is closely related to the oxygen concentration in the exhaust gas, is equal to the stoichiometric air-fuel ratio, the output current of the limiting current type oxygen sensor is 0. Also, as the air-fuel ratio of the air-fuel mixture becomes richer, the output current of the limiting current type oxygen sensor increases in the negative direction, and as the air-fuel ratio becomes leaner, the output current of the limiting current type oxygen sensor increases in the positive direction.

The first air-fuel ratio sensor 19 outputs a signal that is proportional to the oxygen concentration of gas before passing through the catalyst 18, which is the exhaust gas. In other words, the signal from the first air-fuel ratio sensor 19 is proportional to the air-fuel ratio of the air-fuel mixture burned in the combustion chamber. The second air-fuel ratio sensor 20 outputs a signal that is proportional to the oxygen concentration of the gas that has passed through the catalyst 18.

Various types of control of the internal combustion engine 10 are executed by the controller 100. The controller 100 includes electronic components such as a central processing unit (hereinafter, referred to as a CPU) 110, which is a processing circuit, and a memory 120, which stores programs and data that are used in control. The controller 100 is configured to execute various types of control by causing the CPU 110 to execute programs stored in the memory 120.

The controller 100 receives detection signals from various types of sensors such as the air flow meter 16, the first air-fuel ratio sensor 19, the second air-fuel ratio sensor 20, an accelerator sensor, which detects an operation amount of the accelerator pedal, and a crank angle sensor 21, which detects an engine rotation speed NE.

The controller 100 acquires an engine operating state on the basis of the detection signals from the various types of sensors, and executes various types of engine control such as fuel injection control of the injector 17 and opening degree control of the throttle valve 15, in accordance with the engine operating state.

The controller 100 executes a "fuel cutoff" process for suspending fuel injection of the injector 17 in an operating state in which engine torque is unnecessary, for example, when the vehicle is decelerating or traveling downhill. When the fuel cutoff process is executed, fresh air is introduced to the exhaust passage 13. The catalyst 18 is thus exposed to a fuel-lean atmosphere and stores oxygen. When the fuel cutoff process is stopped and fuel injection is started, that is, when recovery from the fuel cutoff process takes place, combustion gas of air-fuel mixture is introduced to the exhaust passage 13. The catalyst 18 is then exposed to a fuel-rich atmosphere and releases stored oxygen.

The controller 100 calculates an oxygen storage amount OSA of the catalyst 18 in the following manner. That is, the controller 100 uses an expression (1) below to calculate a stored oxygen change amount ΔOSA in each infinitesimal time Δt, and successively integrates the stored oxygen change amount ΔOSA to calculate the oxygen storage amount OSA of the catalyst 18.

$$\Delta OSA = 0.23 \times \Delta A/F \times \text{Fuel injection amount } Q \quad (1)$$

The number 0.23 in the expression (1) represents the ratio of oxygen in the air, and the term ΔA/F represents a value obtained by subtracting the stoichiometric air-fuel ratio from the air-fuel ratio detected by the first air-fuel ratio sensor 19. The term Fuel injection amount Q represents the amount of fuel injected by the injector 17 in the infinitesimal time Δt. In the expression (1), when the term ΔA/F has a positive value, the amount of oxygen that has been stored in the catalyst 18 in the infinitesimal time Δt is calculated. In contrast, when the term ΔA/F is a negative value, the amount of oxygen that has been released from the catalyst 18 in the infinitesimal time Δt is calculated.

During the fuel cutoff process, fresh air passes through the catalyst 18, so that oxygen in the fresh air is stored by the catalyst 18. The amount of oxygen stored by the catalyst 18 in the infinitesimal time Δt during the fuel cutoff process is obtained by calculating the stored oxygen change amount ΔOSA in each infinitesimal time Δt shown in an expression (2) below.

$$\Delta OSA = 0.23 \times \text{Intake air amount in infinitesimal time } \Delta t \quad (2)$$

The intake air amount in the infinitesimal time Δt is detected by the air flow meter 16.

When the fuel cutoff process is executed, the oxygen storage amount OSA of the catalyst 18 increases, accordingly. If the oxygen storage amount OSA exceeds an appropriate value C and becomes excessive, NOx reduction in the catalyst 18 slows when combustion of air-fuel mixture is started after recovery from the fuel cutoff process.

In this regard, the controller 100 calculates the integrated value of the intake air amount during the execution of the fuel cutoff process. When the integrated value of the intake air amount exceeds a specified value, the controller 100 determines that the oxygen storage amount OSA has exceeded the appropriate value C and is excessive, and executes a rich air-fuel ratio control when recovery from the fuel cutoff process takes place.

In the rich air-fuel ratio control, the target value of the equivalence ratio is defined as a target equivalence ratio φt, and the controller 100 performs fuel injection while setting the target equivalence ratio φt to a value greater than 1, so that the air-fuel ratio of the air-fuel mixture becomes richer than the stoichiometric air-fuel ratio. When the rich air-fuel ratio control is executed, the catalyst 18 is exposed to a fuel-rich atmosphere. This promotes release of stored oxygen. When the air excess ratio calculated from the output value of the second air-fuel ratio sensor 20 becomes a value close to 1, or when the oxygen storage amount OSA drops to the appropriate value C, the controller 100 sets the target equivalence ratio φt to 1 and ends the rich air-fuel ratio control. Thereafter, the controller 100 performs, for example, the stoichiometric combustion.

The equivalence ratio is an index value that indicates the fuel concentration in air-fuel mixture, and is obtained by dividing the fuel amount corresponding to the stoichiometric air-fuel ratio by the actual fuel amount. The equivalence ratio is 1 when the air-fuel ratio of the air-fuel mixture is the stoichiometric air-fuel ratio, is greater than 1 when the air-fuel ratio of the air-fuel mixture is richer than the stoichiometric air-fuel ratio, and is smaller than 1 when the air-fuel ratio of the air-fuel mixture is leaner than the stoichiometric air-fuel ratio. Also, the air excess ratio is an index value that indicates the excess ratio of air in air-fuel mixture, and is obtained by dividing the air amount corresponding to the stoichiometric air-fuel ratio by the actual air amount. The air excess ratio is 1 when the air-fuel ratio of the air-fuel mixture is the stoichiometric air-fuel ratio, is greater than 1 when the air-fuel ratio of the air-fuel mixture is leaner than the stoichiometric air-fuel ratio, and is smaller than 1 when the air-fuel ratio of the air-fuel mixture is richer than the stoichiometric air-fuel ratio.

The procedure of the processes executed by the controller 100 to set the target equivalence ratio φt will now be described with reference to FIG. 2. The processes shown in FIG. 2 are implemented by the CPU 110 executing programs stored in the memory 120 of the controller 100. The controller 100 repeatedly executes the process during the rich air-fuel ratio control. In the following description, the number of each step is represented by the letter S followed by a numeral.

When this process is started, the controller 100 obtains a rear air excess ratio λr (S100). The rear air excess ratio λr is an air excess ratio that is calculated from an output signal of the second air-fuel ratio sensor 20.

Next, the controller 100 determines whether it is currently a point in time immediately after the rich air-fuel ratio control has started (S110). When determining that it is currently a point in time immediately after the rich air-fuel ratio control has started (S110: YES), the controller 100 sets an excess ratio stored value λm to the rear air excess ratio λr obtained in step S100 (S120). The process of step S120 is a setting process for setting an initial value of the excess ratio stored value λm to the air excess ratio at the start of the rich air-fuel ratio control.

After executing the process of step S120 or when making a negative determination in step S110, the controller 100 executes the process of step S130 as the subsequent process. In the process of step S130, the controller 100 determines whether the rear air excess ratio λr, which has been obtained in step S100, is greater than the current excess ratio stored value λm. When the controller 100 executes the process of step S130 for the first time, the rear air excess ratio λr, which has been obtained in step S100, is equal to the current excess ratio stored value λm. A negative determination is thus made in step S130.

When determining, in the process of step S130, that the rear air excess ratio λr, which has been obtained in step S100, is greater than the current excess ratio stored value λm (S130: YES), the controller 100 updates the excess ratio stored value λm by setting the excess ratio stored value λm to a new value, which is the rear air excess ratio λr (S140). The update of the excess ratio stored value λm is performed each time the rear air excess ratio λr, which is obtained in step S100, exceeds the excess ratio stored value λm. The processes of step S130 and S140 correspond to an update process for setting an excess ratio stored value to an air excess ratio, which is calculated from an output value of an air-fuel ratio sensor during the execution of rich air-fuel ratio control, each time the calculated air excess ratio exceeds the excess ratio stored value.

After executing the process of step S140 or when making a negative determination in step S130, so that current excess ratio stored value λm is maintained, the controller 100 executes the process of step S150 as the subsequent process. In the process of step S150, the controller 100 executes a target equivalence ratio setting process for calculating the target equivalence ratio φt during the execution of the rich air-fuel ratio control on the basis of the excess ratio stored value λm. In the target equivalence ratio setting process, the controller 100 sets the target equivalence ratio φt to a value greater than 1, so that the air-fuel ratio of the air-fuel mixture is richer than the stoichiometric air-fuel ratio. Also, the controller 100 calculates the target equivalence ratio φt such that the target equivalence ratio φt increases as the current excess ratio stored value λm increases.

Next, the controller 100 calculates a fuel injection amount Q of the injector 17 on the basis of the target equivalence ratio φt calculated in step S150 and the current intake air amount GA (S160), and temporarily suspends the current process. Then, the controller 100 controls the injector 17 such that the fuel injection amount Q calculated in step S160 is injected from the injector 17.

An operation and advantages of the present embodiment will now be described with reference to FIG. 3.

Figure 3:
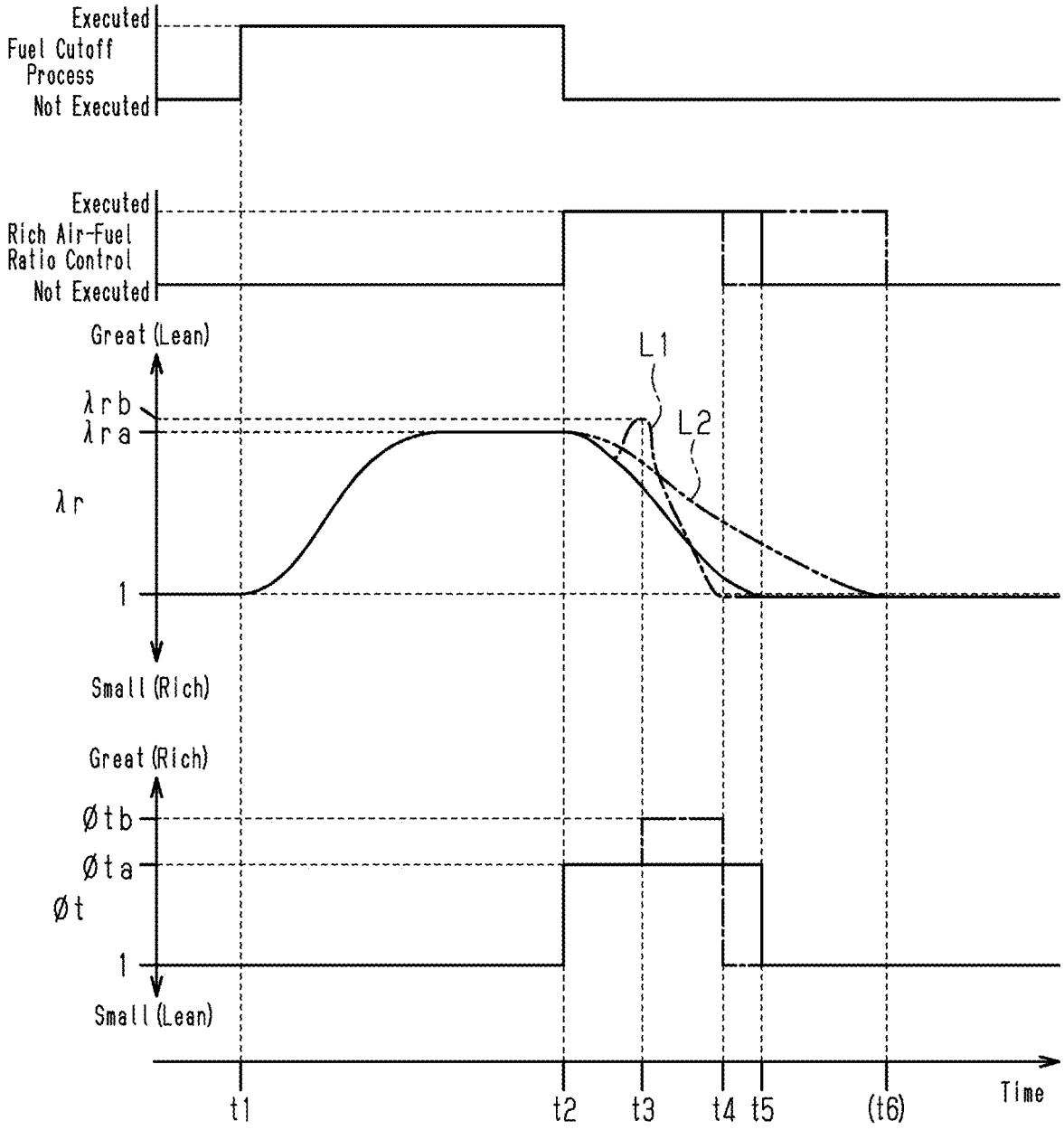
FIG. 3 is a timing diagram showing the operation of the first embodiment.

(1) When the fuel cutoff process is started at a point in time t1 in FIG. 3, fresh air passes through the catalyst 18. The rear air excess ratio λr then gradually changes to a value greater than 1. After the oxygen storage amount OSA of the catalyst 18 reaches the limit, the rear air excess ratio λr is a fixed value that corresponds to the oxygen concentration of the fresh air. If the integrated value of the intake air amount GA exceeds the specified value during the execution of the fuel cutoff process, the rich air-fuel ratio control is started when recovery from the fuel cutoff process takes place at a point in time t2. When the rich air-fuel ratio control is started, the air-fuel mixture that is richer than the stoichiometric air-fuel ratio is burned, so that the catalyst 18 is exposed to a fuel-rich atmosphere. This promotes release of the stored oxygen. Some of the released oxygen reacts with unburned fuel, so that the value of the rear air excess ratio λr gradually decreases from a value corresponding to a lean air-fuel ratio to a value corresponding to the stoichiometric air-fuel ratio. When the rear air excess ratio λr is a value close to 1, or when the oxygen storage amount OSA drops to the appropriate value C, the rich air-fuel ratio control is ended (point in time t5).

If the target equivalence ratio φt is calculated to follow the actual rear air excess ratio λr, which changes during the rich air-fuel ratio control, as indicated by the long-dash double-short-dash line L2 in FIG. 3, the value of the target equivalence ratio φt decreases in correspondence with decrease of the rear air excess ratio λr due to the execution of the rich air-fuel ratio control. Accordingly, release of oxygen from the catalyst 18 gradually slows. This delays the end of the rich air-fuel ratio control (point in time t6), so that the purification performance of the catalyst 18 may fail to be restored at an early stage.

Figure 2:
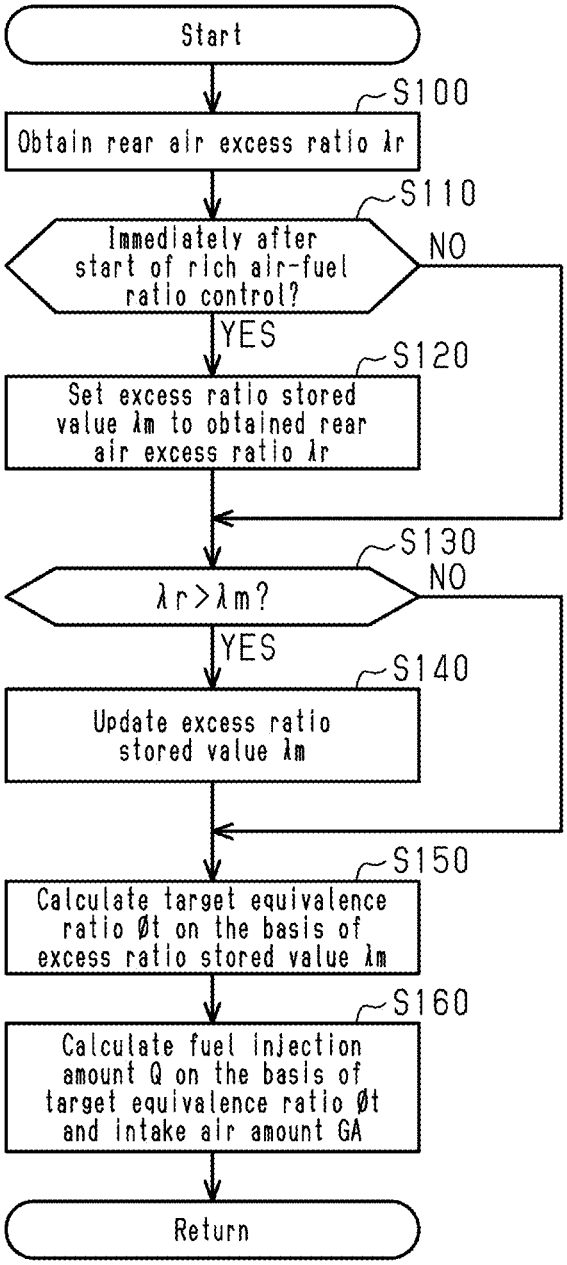
FIG. 2 is a flowchart showing a procedure of processes executed by the controller of the first embodiment.

However, in the present embodiment, the process shown in FIG. 2 is executed to allow the purification performance of the catalyst 18 to be restored at an earlier stage.

That is, when the rich air-fuel ratio control starts at the point in time t2, the initial value of the excess ratio stored value λm is set to a rear air excess ratio λra at the start of the rich air-fuel ratio control. That is, the initial value of the excess ratio stored value λm is set to the rear air excess ratio λra at the point in time t2.

As long as the rear air excess ratio λr during the execution of the rich air-fuel ratio control does not exceed the initial value of the excess ratio stored value λm at the point in time t2, the rear air excess ratio λra at the point in time t2 is maintained as the excess ratio stored value λm, and the target equivalence ratio φt is calculated on the basis of the rear air excess ratio λra.

The rear air excess ratio λra at the point in time t2, that is, the rear air excess ratio λra when the rich air-fuel ratio control is started, increases as the amount of oxygen stored in the catalyst 18 increases during the execution of the fuel cutoff process. The target equivalence ratio φt is calculated on the basis of the rear air excess ratio λra at the point in time t2, and the calculated target equivalence ratio φt is maintained. Thus, during the execution of the rich air-fuel ratio control, the target equivalence ratio φt is maintained as a large value on the rich air-fuel ratio side. As a result, release of oxygen from the catalyst 18 is promoted, and the purification performance of the catalyst 18 is restored at an early stage.

(2) When the output signal of the second air-fuel ratio sensor 20 changes during the execution of the rich air-fuel ratio control so that a rear air excess ratio λrb exceeds the excess ratio stored value λm (the rear air excess ratio λra) as indicated by the long-dash short-dash line L1 in FIG. 3

(point in time t3), the new excess ratio stored value λm is set to the rear air excess ratio λrb at the point in time t3, so that the excess ratio stored value λm is updated. Since the updated air excess ratio stored value λm is greater than the air excess ratio stored value λm before the update, the value of the target equivalence ratio φtb that is calculated on the basis of the updated air excess ratio stored value λm is greater than the target equivalence ratio φta calculated on the basis of the air excess ratio stored value λm before the update. The catalyst 18 is thus exposed to a more fuel-rich atmosphere, which further promotes release of the stored oxygen. This advances the end of the rich air-fuel ratio control (point in time t4), so that the purification performance of the catalyst 18 is restored at an earlier stage.

Second Embodiment

A controller 100 for an internal combustion engine according to a second embodiment will now be described with reference to FIG. 4.

In the first embodiment, the update process of the excess ratio stored value λm is executed. In the present embodiment, such an update process is omitted. The present embodiment will now be described focusing on such differences.

Figure 4:
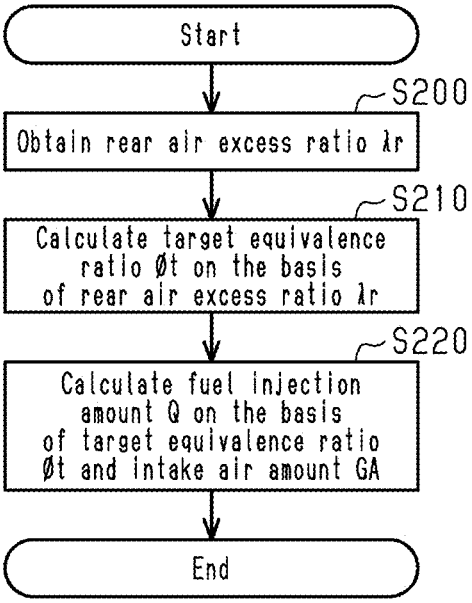
FIG. 4 is a flowchart showing a procedure of processes executed by a controller of a second embodiment.

FIG. 4 illustrates the procedure of the processes executed by the controller 100 to set the target equivalence ratio φt. The processes shown in FIG. 4 are implemented by the CPU 110 executing programs stored in the memory 120 of the controller 100. The controller 100 executes the processes of FIG. 4 in synchronization with the start of the rich air-fuel ratio control. In the following description, the number of each step is represented by the letter S followed by a numeral.

When this process is started, the controller 100 obtains a rear air excess ratio λr (S200). The rear air excess ratio λr is an air excess ratio that is calculated from an output signal of the second air-fuel ratio sensor 20.

Next, the controller 100 executes a target equivalence ratio setting process for calculating the target equivalence ratio φt during the execution of the rich air-fuel ratio control on the basis of the rear air excess ratio λr obtained in step S200 (S210). In the target equivalence ratio setting process, the controller 100 sets the target equivalence ratio φt to a value greater than 1, so that the air-fuel ratio of the air-fuel mixture is richer than the stoichiometric air-fuel ratio. Also, the controller 100 calculates the target equivalence ratio φt such that the target equivalence ratio φt increases as the rear air excess ratio λr obtained in step S200 increases.

Next, the controller 100 calculates a fuel injection amount Q of the injector 17 on the basis of the target equivalence ratio φt calculated in step S210 and the current intake air amount GA (S220), and ends the current process. Then, the controller 100 controls the injector 17 such that the fuel injection amount Q calculated in step S220 is injected from the injector 17.

In this embodiment also, the target equivalence ratio φt is calculated on the basis of the rear air excess ratio λr at the start of the rich air-fuel ratio control, and the calculated target equivalence ratio φt is maintained. Thus, during the execution of the rich air-fuel ratio control, the target equivalence ratio φt is maintained as a large value on the rich air-fuel ratio side. Thus, the present embodiment has the same advantage as the above described advantage (1). As a result, release of oxygen from the catalyst 18 is promoted, and the purification performance of the catalyst 18 is restored at an early stage.

The above-described embodiments may be modified as follows. The above-described embodiments and the following modifications can be combined as long as the combined modifications remain technically consistent with each other.

The execution condition and/or termination condition of the rich air-fuel ratio control may be changed.

The controller 100 is not limited to a device that includes the CPU 110 and the memory 120 and executes software processing. For example, a dedicated hardware circuit (such as an application-specific integrated circuit (ASIC)) may be provided that executes at least part of the software processing executed in each of the above-described embodiments. That is, the controller 100 may be modified as long as it has any one of the following configurations (a) to (c). (a) A configuration including a processor that executes all of the above-described processes according to programs and a program storage device such as a memory that stores the programs. (b) A configuration including a processor and a program storage device that execute part of the above-described processes according to the programs and a dedicated hardware circuit that executes the remaining processes. (c) A configuration including a dedicated hardware circuit that executes all of the above-described processes. A plurality of software processing circuits each including a processor and a program storage device and a plurality of dedicated hardware circuits may be provided. That is, the above processes may be executed in any manner as long as the processes are executed by processing circuitry that includes at least one of a set of one or more software processing circuits and a set of one or more dedicated hardware circuits.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A controller for an internal combustion engine, the controller being configured to control the internal combustion engine that includes a catalyst provided in an exhaust passage and an air-fuel ratio sensor that outputs a signal proportional to an oxygen concentration of gas that has passed through the catalyst, wherein the controller is configured to execute a rich air-fuel ratio control for performing fuel injection while setting a target equivalence ratio such that, at recovery from a fuel cutoff process, an air-fuel ratio of air-fuel mixture is richer than a stoichiometric air-fuel ratio, a setting process for setting an initial value of an excess ratio stored value to an air excess ratio that is calculated from an output value of the air-fuel ratio sensor at start of the rich air-fuel ratio control, a target equivalence ratio setting process for setting a target equivalence ratio that is maintained during execution of the rich air-fuel ratio control such that the target equivalence ratio increases as the excess ratio stored value increases, and an update process for setting the excess ratio stored value to an air excess ratio that is calculated from an output value of the air-fuel ratio sensor during execution of the rich air-fuel ratio control, each time the air excess ratio exceeds the excess ratio stored value.

2. A controller configured to control an internal combustion engine that includes a catalyst provided in an exhaust passage and an air-fuel ratio sensor that outputs a signal proportional to an oxygen concentration of gas that has passed through the catalyst, wherein the controller comprises processing circuitry, and the processing circuitry is configured to execute a rich air-fuel ratio control for performing fuel injection while setting a target equivalence ratio such that, at recovery from a fuel cutoff process, an air-fuel ratio of air-fuel mixture is richer than a stoichiometric air-fuel ratio, a setting process for setting an initial value of an excess ratio stored value to an air excess ratio that is calculated from an output value of the air-fuel ratio sensor at start of the rich air-fuel ratio control, a target equivalence ratio setting process for setting a target equivalence ratio that is maintained during execution of the rich air-fuel ratio control such that the target equivalence ratio increases as the excess ratio stored value increases, and an update process for setting the excess ratio stored value to an air excess ratio that is calculated from an output value of the air-fuel ratio sensor during execution of the rich air-fuel ratio control, each time the air excess ratio exceeds the excess ratio stored value.

* * * * *